US005417352A

United States Patent [19]

Jen

[11] Patent Number: 5,417,352

[45] Date of Patent: May 23, 1995

[54] GARMENT SUPPORT WITH CHANGEABLE HANGING HOOK AND SUPPORT BEAMS

[76] Inventor: Lin C. Jen, 2, Lane 54, Jen Ai Street, Shin Chuang, Taipei, Taiwan, Prov. of China

[21] Appl. No.: 231,683

[22] Filed: Apr. 25, 1994

[51] Int. Cl.[6] ..... A47G 25/14

[52] U.S. Cl. ..... 223/85; 223/92; 223/DIG. 4; 403/174; 403/178

[58] Field of Search ..... 223/85, 88, 92, 95, 223/DIG. 4; 403/330, 326, 174, 169, 178, 217; 446/73

[56] References Cited

U.S. PATENT DOCUMENTS

| | | | |
|---|---|---|---|
| 901,002 | 10/1908 | Henderson | 223/88 |
| 2,376,269 | 5/1945 | Pauli | 223/88 |
| 3,963,154 | 6/1976 | Schwartz et al. | 223/85 |
| 4,981,242 | 1/1991 | Grahm | 223/85 |
| 5,074,446 | 12/1991 | Suddath | 223/92 |
| 5,078,307 | 1/1992 | Suddath | 223/88 |
| 5,201,443 | 4/1993 | Oswald | 223/85 |

*Primary Examiner*—Clifford D. Crowder
*Assistant Examiner*—Bibhu Mohanty
*Attorney, Agent, or Firm*—Morton J. Rosenberg; David I. Klein

[57] ABSTRACT

A garment support with changeable hanging hook and support beams, in which the hanging hook and support beams can be easily changed for meeting various sizes and patterns of different kinds of garments. A decorative toy-like member can be associated with the garment support for achieving pleasing effect.

2 Claims, 6 Drawing Sheets

GARMENT SUPPORT WITH CHANGEABLE HANGING HOOK AND SUPPORT BEAMS

BACKGROUND OF THE INVENTION

The present invention relates to a garment support with changeable hanging hook and support beams, and more particularly to a garment support in which the hanging hook and support beams can be easily changed for meeting various sizes and patterns of different kinds of garments. A decorative toy-like member can be associated with the garment support for achieving pleasing effect.

As shown in FIGS. 6 and 7, a conventional garment support is generally made of an iron wire by bending the same into a frame pattern or made of plastic material by integral injection molding. Such garment support is widely used to support and hang a garment. However, such garment support has fixedly dimension and pattern and can only support certain kinds of garments with limited sizes and patterns. For some other garments which have larger or smaller sizes or different patterns, it is necessary to use a corresponding larger or smaller garment support instead to suitably support the garments. Therefore, a user often needs to prepare various sizes and patterns of garment supports for meeting respective requirements of different kinds of garments.

In addition, the conventional garment support is not provided with any decorative member so that the appearance of the garment support cannot create a pleasing effect for the user such as a child.

SUMMARY OF THE INVENTION

It is therefore a primary object of the present invention to provide a garment support with changeable hanging hook and support beam, wherein the hanging hook and support beam can be easily changed for meeting various sizes and patterns of different kinds of garments. Moreover, a decorative toy-like member can be associated with the garment support for achieving a pleasing effect.

The present invention can be best understood through the following description and accompanying drawing, wherein:

DETAILED DESCRIPTION OF THE PREFERRED EMBODIMENT

Figure 1:
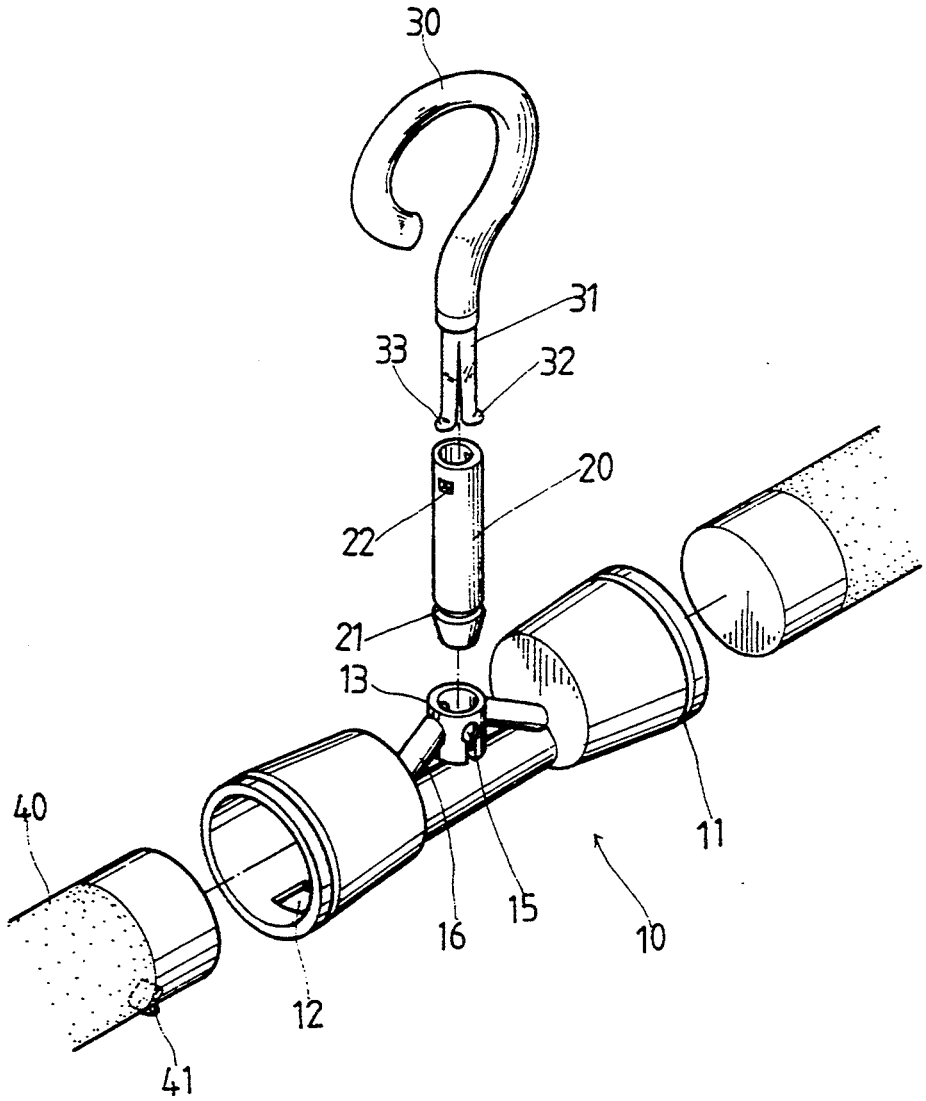
FIG. 1 is a perspective exploded view of the present invention.
Figure 2:
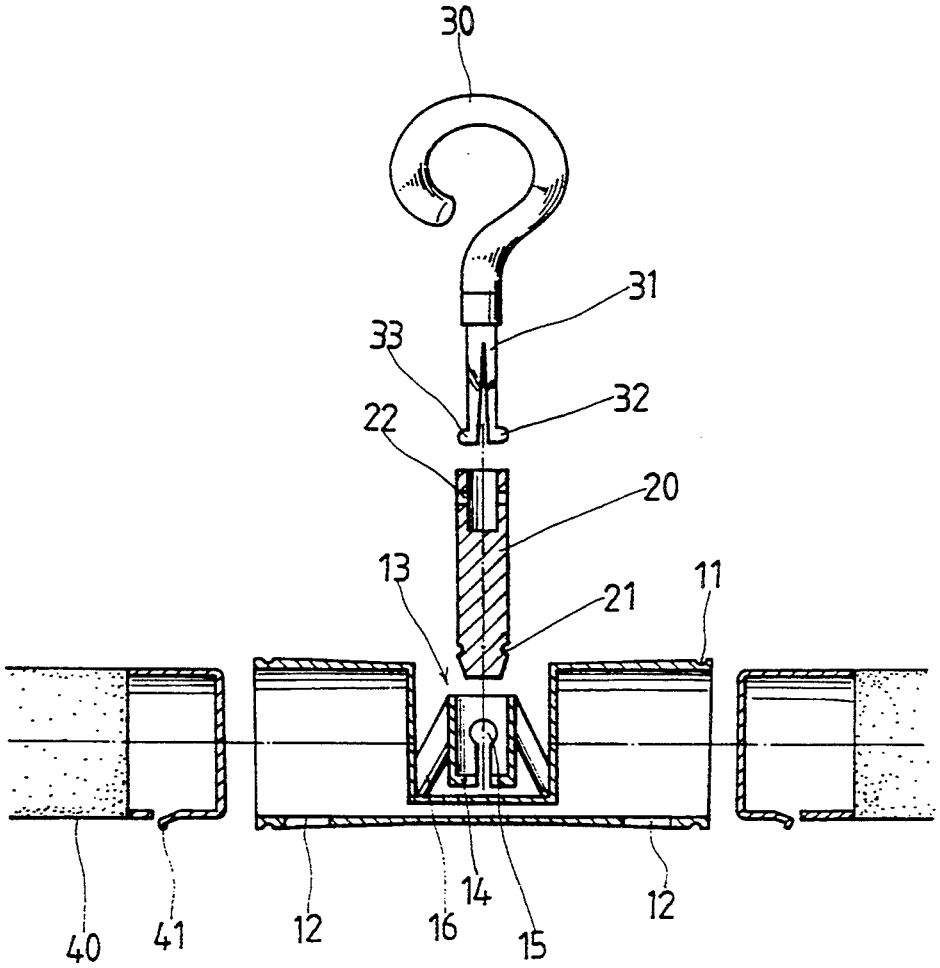
FIG. 2 is a sectional exploded view of the present invention.

Please refer to FIGS. 1 and 2. The garment support of the present invention includes a support body 10 having a fixing seat 13, an insert connector 20 connected with the fixing seat 13, a hanging hook 30 connected with the insert connector 20, and two support beams 40 connected with the support body 10. The support body 10 has a rod-like middle portion and two sleeve-like end portions connected by the middle portion substantially at a bottom side of the support body 10. Each end portion of the support body 10 is formed with an opening 12 located at a bottom section of the end portion and spaced from an outer edge thereof by a certain distance. The end portion is further formed with an annular fixing groove 11 located between the opening 12 and the outer edge of the end portion. The fixing seat 13 of the support body 10 is located on a central section of the rod-like middle portion of the support body 10 and supported by two rod members 16. The fixing seat 13 is such dimensioned that a top end thereof will not protrude beyond the outer edge of the end portion of the support body 10. The fixing seat 13 is sleeve-like, having two opposite axial slots 15 and a flange section 14 located at an inner side of a bottom end of the fixing seat 13. Each slot 15 has a circular top end and extends from the top end to the bottom end of the fixing seat 13, whereby the bottom end of the fixing seat 13 can be resiliently expanded.

The insert connector 20 is rod-like and adapted to be inserted into the fixing seat 13, having an annular groove 21 spaced from a bottom end of the insert connector 20 by a certain distance for engaging with the flange section 14 of the fixing seat 13. The insert connector 20 further has a hollow top end portion and two opposite orifices 22 located on two sides of the top end portion of the insert connector 20.

The hanging hook 30 has a C-shaped upper portion for hanging the garment support and a downward extending fork-like lower portion having two fixing tenons 31 each of which has a horizontal projecting section 32, 33. The lower portion of the hanging hook 30 is adapted to be inserted into the hollow upper end portion of the insert connector 20 with the projecting sections 32, 33 engaged with the orifices 22 of the insert connector 20 so as to secure the hanging hook 30 thereon.

Each support beam 40 is rod-like, having a tenon 41 spaced from an end of the support beam 40 by a certain distance, whereby the support beam 40 is adapted to be inserted into the end portion of the support body 10 with the tenon 41 engaged with the opening 12 of the support body 10 so as to secure the support beam 40 with the support body 10.

Figure 3:
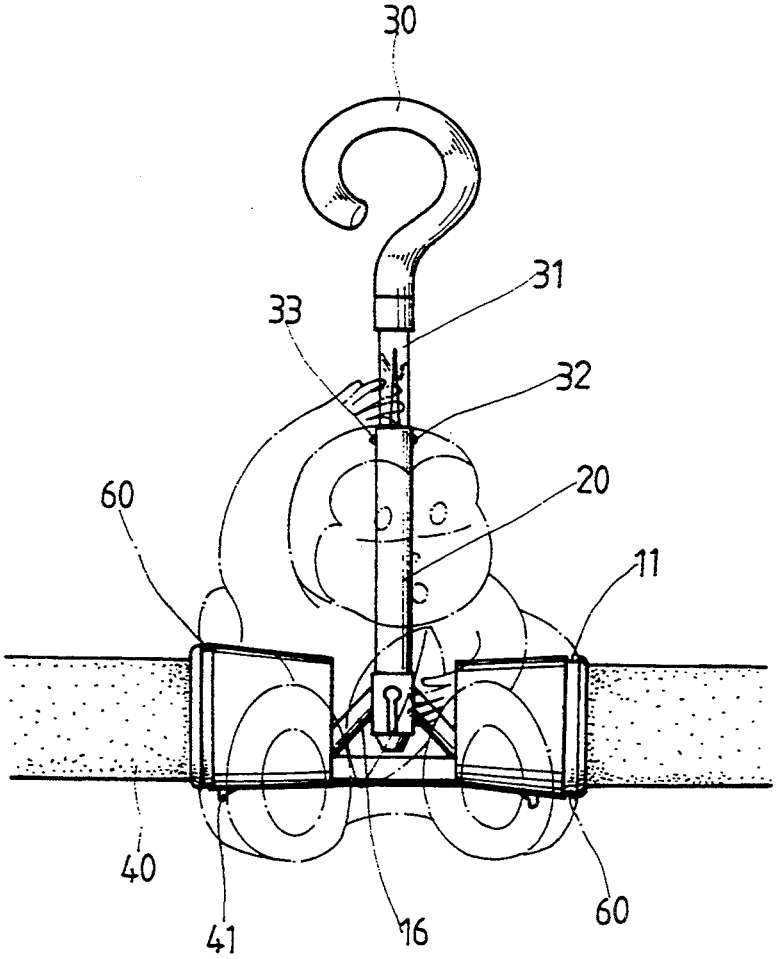
FIG. 3 is a sectional assembled view according to FIG. 2, wherein the phantom lines show the decorative toy-like member associated with the garment support.
Figure 4:
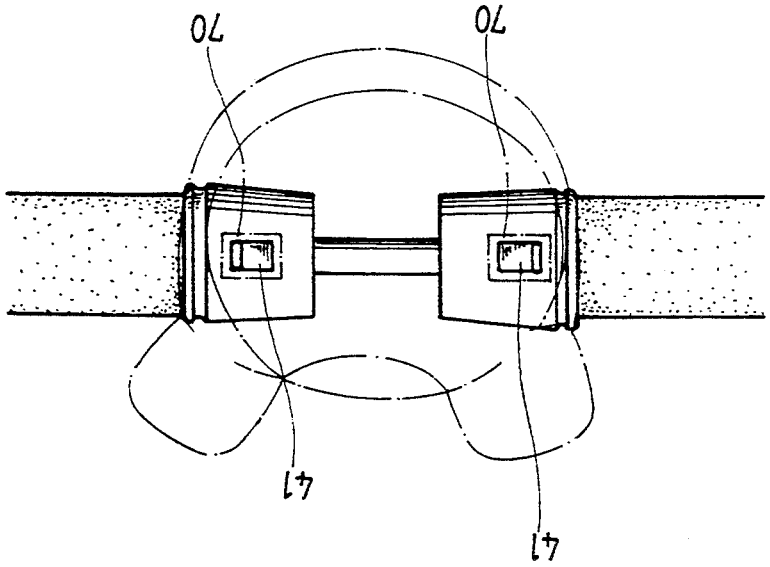
FIG. 4 is a bottom view, showing that the support beams are engaged with the support body.
Figure 5:
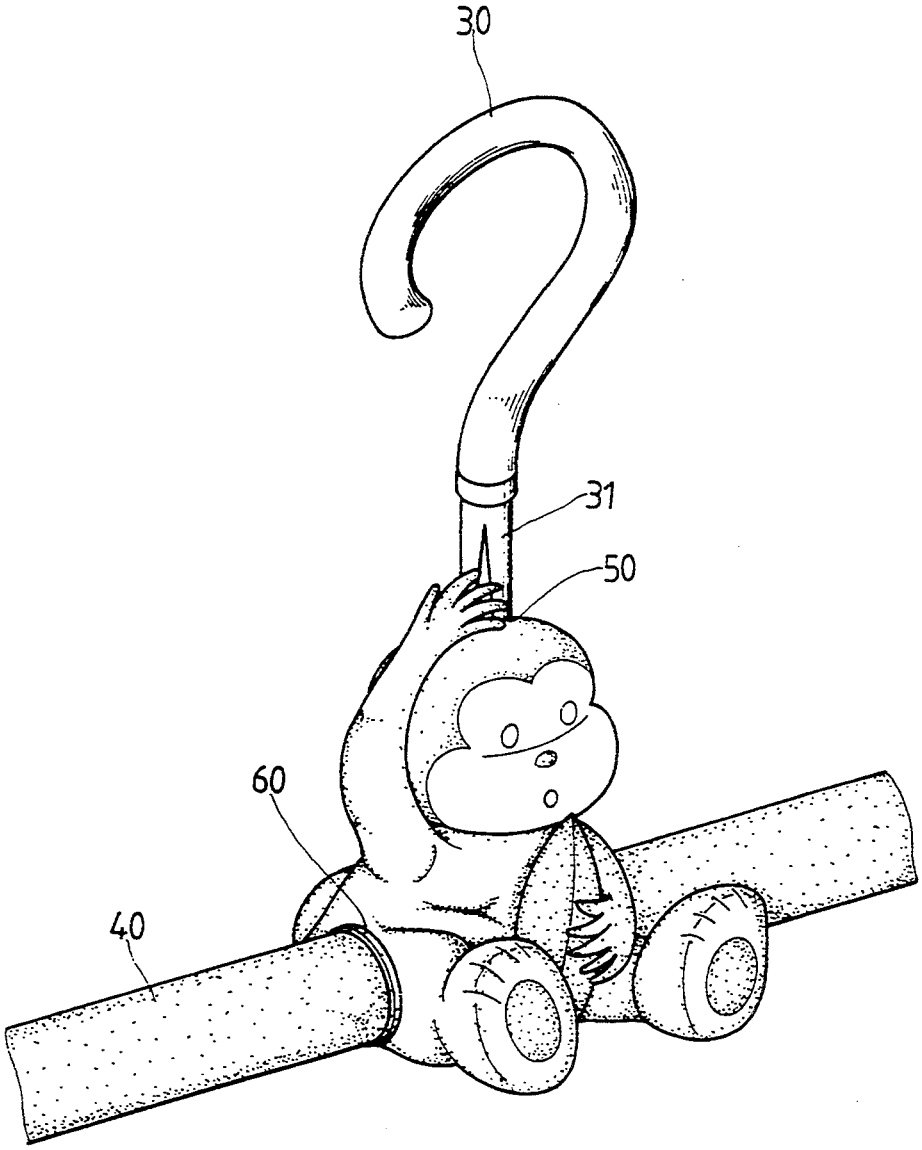
FIG. 5 is a perspective view, showing the assembly of the decorative toy-like member and the garment support.
Figure 6:
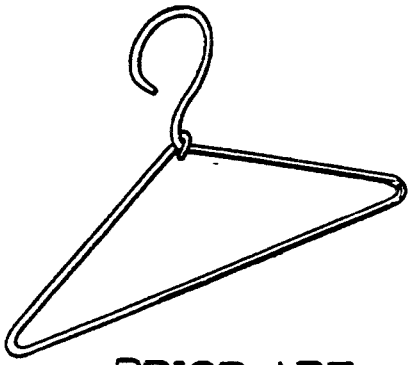
PRIOR ART FIG. 6
FIG. 6 shows a conventional garment support.
Figure 7:
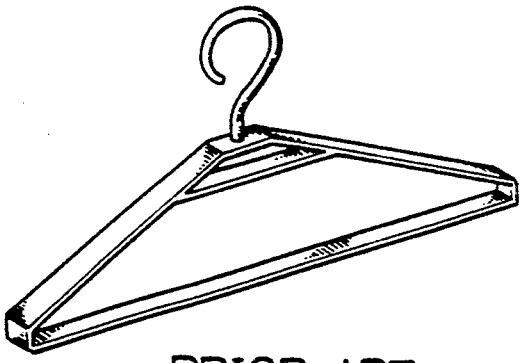
PRIOR ART FIG. 7
FIG. 7 shows another conventional garment support.

Please refer to FIGS. 3 to 5. A decorative and hollow toy-like member which is made of soft material can be associated with the garment support. The toy-like member is formed with a top hole 50 corresponding to the insert connector 20, two lateral holes 60 corresponding to the end portions of the support body 10, and two bottom holes 70 corresponding to the openings 12 of the support body 10 and the tenons 41 of the support beams 40. The toy-like member is assembled with the garment support in such a manner that the support body 10 is first placed into the toy-like member near a bottom portion thereof with the annular grooves 11 of the support body 10 engaged with the lateral holes 60 of the toy-like member. At this time, the openings 12 of the support body 10 are right positioned above the bottom holes 70 of the toy-like member. Then, the insert connector 20 is extended through the top hole 50 of the toy-like member to insert into the fixing seat 13. Finally, the support beams 40 are inserted into the end portions of the support body 10 with the tenons 41 engaged with the openings 12 of the support body 10 and the bottom holes 70 of the toy-like member.

Please refer to FIGS. 3 to 5. The garment support is disassembled in such a manner that the fixing tenons 31 of the hanging hook 30 are first pressed inward, allowing the hanging hook 30 to be drawn out of the fixing seat 13, and then the tenons 41 of the support beams 40 are pressed inward, allowing the support beams 40 to be drawn out of the support body 10.

In conclusion, the hanging hook 30 and support beams 40 are easily detachably associated with the support body 10. Therefore, the hanging hook 30 and support beams 40 can be freely replaced by other sizes and patterns of hanging hook and support beams for meeting the requirements of different kinds of garments. Moreover, the toy-like member serves to create pleasing effect for the user, especially for a child.

It is to be understood that the above description and drawings are only used for illustrating one embodiment of the present invention, not intended to limit the scope thereof. Any variation and derivation from the above description and drawings should be included in the scope of the present invention.

What is claimed is:

1. A garment support with changeable hanging hook and support beams, said garment support comprising a support body having a fixing seat, an insert connector connected with said fixing seat, a hanging hook connected with said insert connector, and two support beams connected with said support body, wherein:

said support body has a rod-like middle portion and two sleeve-like end portions connected by said middle portion substantially at a bottom side of said support body, each end portion of said support body being formed with an opening located at a bottom section of said end portion and spaced from an outer edge thereof by a certain distance, said end portion being further formed with an annular fixing groove located between said opening and said outer edge of said end portion, said fixing seat of said support body being located on a central section of said rod-like middle portion of said support body and supported by two rod members, said fixing seat being such dimensioned that a top end thereof will not protrude beyond said outer edge of said end portion of said support body, said fixing seat being sleeve-like, having two opposite axial slots and a flange section located at an inner side of a bottom end of said fixing seat, each slot having a circular top end and extending from said top end to said bottom end of said fixing seat, whereby said bottom end of said fixing seat is resiliently expandable;

said insert connector is rod-like and adapted to be inserted into said fixing seat, having an annular groove spaced from a bottom end of said insert connector by a certain distance for engaging with said flange section of said fixing seat, said insert connector further having a hollow top end portion and two opposite orifices located on two sides of said top end portion of said insert connector;

said hanging hook has a C-shaped upper portion for hanging said garment support and a downward extending fork-like lower portion having two fixing tenons each of which has a horizontal projecting section, said lower portion of said hanging hook being adapted to be inserted into said hollow upper end portion of said insert connector with said projecting sections engaged with said orifices of said insert connector so as to secure said hanging hook thereon; and each support beam is rod-like, having a tenon spaced from an end of said support beam by a certain distance, whereby said support beam is adapted to be inserted into said end portion of said support body with said tenon engaged with said opening of said support body so as to secure said support beam with said support body.

2. A garment support as claimed in claim 1, wherein a decorative and hollow toy-like member which is made of soft material is associated with said garment support, said toy-like member is formed with a top hole, two lateral holes, and two bottom holes, whereby said toy-like member is assembled with said garment support in such a manner that said support body is first placed into said toy-like member near a bottom portion thereof with said annular grooves of said support body engaged with said lateral holes of said toy-like member and with said openings of said support body positioned above said bottom holes of said toy-like member, and then said insert connector is extended through said top hole of said toy-like member to insert into said fixing seat, and finally, said support beams are inserted into said end portions of said support body with said tenons of said support beams engaged with said openings of said support body and said bottom holes of said toy-like member.

* * * * *